US006698877B2

(12) United States Patent
Urlaub et al.

(10) Patent No.: US 6,698,877 B2
(45) Date of Patent: Mar. 2, 2004

(54) OFFSET PRINTING APPARATUS FOR APPLYING A SUBSTANCE

(75) Inventors: John J. Urlaub, Oshkosh, WI (US); Robert L. Clarke, Appleton, WI (US); Andrew J. Feyen, Evansville, IN (US); Paul D. Beuther, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 11 days.

(21) Appl. No.: 10/186,349

(22) Filed: Jun. 28, 2002

(65) Prior Publication Data

US 2004/0001917 A1 Jan. 1, 2004

(51) Int. Cl.[7] ..... B41J 2/01

(52) U.S. Cl. ..... 347/103; 347/101; 101/217; 101/271

(58) Field of Search ..... 347/103, 102, 347/101, 107, 1; 101/170, 217, 271

(56) References Cited

U.S. PATENT DOCUMENTS

| | | | | |
|---|---|---|---|---|
| 4,143,381 A | * | 3/1979 | Downie | 347/103 |
| 5,209,953 A | * | 5/1993 | Grupe et al. | 101/170 |
| 5,353,105 A | * | 10/1994 | Gundlach et al. | 347/103 |
| 5,471,233 A | * | 11/1995 | Okamoto et al. | 347/103 |
| 5,823,107 A | | 10/1998 | Beisel et al. | |
| 5,842,414 A | * | 12/1998 | Yoshida et al. | 101/217 |
| 6,000,787 A | | 12/1999 | Weber et al. | |
| 6,084,609 A | | 7/2000 | Manini et al. | |
| 6,257,138 B1 | | 7/2001 | Bialek | |
| 6,557,979 B2 | * | 5/2003 | Ohsawa et al. | 347/55 |

OTHER PUBLICATIONS

KCX–119 Application entitled Modified Siloxane Yielding Transferring Benefits from Soft Tissue Paper; Dale A. Burghardt et al. Application No. 09/742,666.

* cited by examiner

*Primary Examiner*—Stephen D. Meier
*Assistant Examiner*—Manish Shah
(74) *Attorney, Agent, or Firm*—Dority & Manning, P.A.

(57) ABSTRACT

An offset print apparatus for applying a substance to a web is provided. The offset print apparatus has a transfer roll that is capable of being rotated. An ink jet printer is present and has a print head that is located proximate to the transfer roll. The print head has a plurality of orifices from which the substance is dispensed onto the transfer roll. The distance between the surface of the print head and the transfer roll is defined as a throw distance. A web is present and contacts the transfer roll. The substance is dispensed onto the transfer roll and is transferred to the web through contact of the transfer roll and the web. The web has an amount of dust laden boundary air that is formed proximate to the web when the web is moving. The print head of the ink jet printer is not in contact with the boundary air.

35 Claims, 8 Drawing Sheets

OFFSET PRINTING APPARATUS FOR APPLYING A SUBSTANCE

BACKGROUND

Production of paper products such as paper towels, tissues, napkins, and the like often employ the use of several manufacturing steps. One of these manufacturing steps involves the application of a substance onto the web from which the paper product is made. The purpose of applying a substance onto the web is due to a desire to change the functional properties of the resulting paper product. For instance, the substance may be a strength agent, a softening agent, or a debonding agent, or any other substance which affects the functional properties of the product. Application of these types of substances to a web will result in the final paper product having desired characteristics. Typically, strengthening agents are added to a web that is made into paper towels in order to provide for a paper towel that will not disintegrate upon contact with water or other liquids. Alternatively, debonding agents are sometimes applied to a web that is made into toilet tissue such that the resulting product will break up upon contact with water. As such, the application of a substance that modifies the functional properties of a paper product is an important step in the manufacturing these products.

One method known in the art that is used to apply a substance onto a web is known as direct printing. Direct printing can employ flexographic, gravure, or ink jet technology. Ink jet technology includes a device known as an ink jet print head that has a plurality of orifices. A substance may be expelled from one or more of these orifices thus exiting the print head of the ink jet printer. Drops of the substance then travel a throw distance between the print head and the web or other surface onto which the substance is to be applied. The orifices of the print head may be aligned in a single row or may be formed having various patterns. The substance may be expelled from these orifices either simultaneously or through selected orifices at any given time. Although ink jet technology is commonly used in ink printers which apply printing to a paper, ink jet technology is also known in the art as a method of applying substances to a paper in order to effect the functional properties of the paper.

Direct printing may sometimes employ a guide roll onto which the moving web is contacted. The ink jet print head may then apply the substance onto the web as the web is rolled over the guide roll. Alternatively, a transfer roll may not be present in direct printing. Here, the ink jet print head applies the substance to a moving web that is stretched in between two points, for instance two other rolls. The moving web may create a layer of boundary air that is approximately one-half inch to one inch in distance from the surface of the moving web. Although, it is to be understood that in the present invention that any size of boundary air may be present and the invention is not limited to any particular distance. This boundary air is a turbulent airflow that has a significant amount of dust present. The dust is formed by the particles that create the web. In ink jet printing, the throw distance from the print head to the surface onto which the substance is applied is typically less than fifteen millimeters, and is commonly less than five millimeters. Therefore, in direct printing the print head is typically within the boundary air. It is often the case that the dust will build up on the print head of the ink jet printer due to static effects. This buildup of dust on the print head can significantly impact the dispensing of the substance from the ink jet printer. For instance, several of the orifices can become jammed or partially clogged therefore preventing the desired distribution of the substance onto the web. Additionally, a reduced amount of substance can be applied from that which is desired.

The production of paper products typically occurs at a fast rate. Therefore, the web is moved at a high rate of speed producing boundary air which is also moving at an elevated speed. Due to the fact that ink jet technology propels drops of the substrate onto the web, this fast moving boundary air can potentially cause problems. For instance, the boundary air may act as a barrier to prevent the drops of the substrate from reaching the web. In addition, the boundary air may effect the location onto which the substance is placed on the web causing a buildup on some parts of the web and leaving other parts of the web with none or a reduced amount of the substance. In most circumstances, such an uneven dispersion of the substance is undesired. Additionally, the buildup of dust on the ink jet print head can cause the formation of satellite drops which are smaller drops of the chemistry that are formed due to drop break-up upon impact with dust or due to improper drop formation. These satellite drops are smaller and have a greater potential of being swept away by the boundary air and/or being inhaled by a person in the proximity of the printing equipment. These problems exist at relatively low speeds of a moving web, such as speeds less than 500 feet per minute, but become worse at higher speeds.

Although it is possible to move the ink jet print head away from the boundary air such that the problem of dust buildup is not as severe, this modification causes other side effects. First, the ink jet print head is designed to operate at relatively small throw distances. Having a larger throw distance will result in a loss of resolution of the substance applied to the web. For instance, more overlapping of the substance applied to the web will occur. Additionally, the substance has a greater chance of being swept away due to the boundary air. The exact placement of the substance onto the web will not be controllable since the distance the drop of the substance is thrown will be great and will be through a turbulent airflow.

SUMMARY

Various features and advantages of the invention will be set forth in part in the following description, or may be obvious from the description, or may be learned through practice of the present invention.

The present invention provides for an offset print apparatus for applying a substance to a moving web. The offset print apparatus includes a transfer roll that is capable of being rotated. A moving web is provided and is in contact with a first circumferential portion of the transfer roll. The moving web moves over or under the transfer roll and stays in contact with the first circumferential portion of the transfer roll while moving over the transfer roll. A dispenser is located proximate to a second circumferential portion of the transfer roll and has at least one orifice. A substance may also be present and be dispensed from the dispenser through the at least one orifice. The substance is dispensed onto the transfer roll without having the dispenser contact the transfer roll. The transfer roll rotates the substance into engagement with the moving web such that at least a portion of the substance is applied to the moving web.

The present invention also provides for an offset print apparatus for applying a substance to a web that includes a transfer roll. An ink jet printer is provided that has a print head located proximate to the transfer roll. The print head has a plurality of orifices from which the substance is dispensed onto the transfer roll. The distance between the surface of the print head and the transfer roll is defined as a throw distance. A web contacts the transfer roll such that the substance that is dispensed onto the transfer roll is transferred to the web through contact of the transfer roll and the web. The web has an amount of dust laden boundary air that is formed proximate to the web when the web is moving. The print head of the ink jet printer need not come into contact with the dust laden boundary air that is formed when the web is moving.

The present invention also encompasses an apparatus as discussed above where the substance is applied to affect the functional properties of the web.

A further exemplary embodiment of the present invention is provided as an apparatus as immediately discussed where the substance is selected from the group that consists of but is not limited to strength agents, softening agents, and debonding agents.

A further exemplary embodiment of the present invention exists in an apparatus as previous discussed where the dispenser is an ink jet printing apparatus.

Alternatively, the present invention includes an offset print apparatus as previously discussed which further has a doctor blade that is located proximate to the transfer roll. The doctor blade removes any of the substance that remains on the transfer roll after engagement of the substance with the moving web.

Alternatively, the present invention includes an apparatus as set forth above where the moving web is moving at a speed of between about 5,000 feet per minute and about 8,000 feet per minute in one exemplary embodiment, and a speed between about 500 and 3,000 feet per minute in another exemplary embodiment.

Additionally, the present invention includes an exemplary embodiment of an offset print apparatus as discussed above where the throw distance is between about 2 and about 3 millimeters in one exemplary embodiment, and can be between 1 and 20 millimeters in other exemplary embodiments.

Another exemplary embodiment of the invention exists where the print head is spaced away from and not in contact with the boundary air that is formed by the moving web.

The present invention also encompasses a method for applying a substance to a moving web. The method includes the step of rotating a transfer roll. A web is moved over or under a first circumferential portion of the transfer roll. The web stays in contact with the first circumferential portion while being moved over or under the transfer roll. A dispenser is located proximate to a second circumferential portion of the transfer roll. The dispenser is located such that boundary air from the moving web is substantially remote from the dispenser. A substance is dispensed from the dispenser onto the transfer roll at the second circumferential portion. The substance is rotated into engagement with the moving web so that at least a portion of the substance is applied to the moving web.

DETAILED DESCRIPTION

Figure 1:
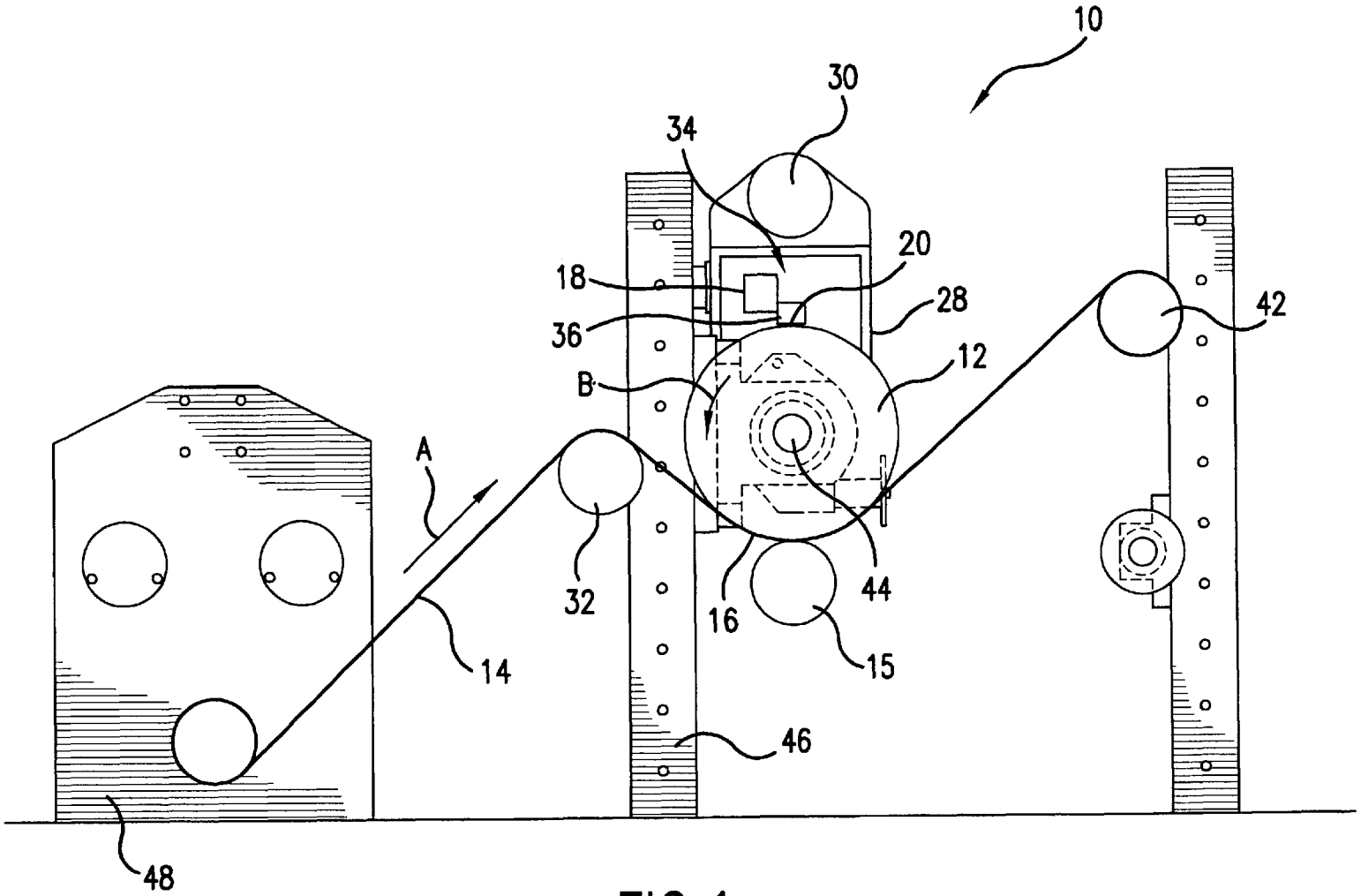
FIG. 1 is an elevation view of an exemplary embodiment of an offset print apparatus in accordance with the present invention. The offset print apparatus is shown having a dispenser that is an ink jet printer.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

FIG. 1 shows an exemplary embodiment of an offset print apparatus 10 in accordance with the present invention. The offset print apparatus 10 is shown having a transfer roll 12 being present. The transfer roll 12 is rotationally mounted onto a frame 46 via a shaft 44. The transfer roll 12 may be cylindrical in shape and have a smooth outer surface. However, it is to be understood that other exemplary embodiments of the present invention will have a transfer roll 12 that does not have a smooth outer surface. The transfer roll 12 may be any type of roll known in the art in other exemplary embodiments of the present invention, for instance, one such roll is disclosed in U.S. Pat. No. 6,257,138 B1 which is incorporated by reference in its entirety for all purposes. The transfer roll 12 may be made of any type of material, for instance, steel. Also, the transfer roll 12 may have a smooth, textured, or patterned surface. Additionally, an elastomeric coating may or may not be present on the transfer roll 12. The transfer roll 12 may be a vacuum roll in certain exemplary embodiments of the present invention. A vacuum roll is a roll that has a vacuum applied to the interior thereto such that a web 14 is securedly pulled against the vacuum roll. However, it is to be understood that in other exemplary embodiments of the present invention, the transfer roll 12 is not a vacuum roll. Additionally, in other exemplary embodiments of the present invention the transfer roll 12 may be replaced by a belt having or not having a vacuum present underneath. As such, it is to be understood that as used herein and in the claims the term "transfer roll" is broad enough to be an element capable of transferring substance.

A moving web 14 is present in the offset print apparatus 10. The moving web 14 moves in the direction of arrow A from an upstream manufacturing process 48. The web 14 employed in FIG. 1 may be, for example, a tissue. However, it is to be understood that the web 14 may be used to form other products besides a tissue in other exemplary embodiments of the present invention. For instance, the web 14 may be used to form paper towels, paper napkins, hand wipes, toilet tissues, or the like. The offset print apparatus 10 is not limited to using a particular type of web 14.

The web 14 moves around an upstream directional roll 32 from which the direction of web 14 is changed. At this point, the web 14 contacts a first circumferential portion 16 of the transfer roll 12. The web 14 may be moved at speeds of between 500 and 8,000 feet per minute in certain exemplary embodiments of the present invention.

The transfer roll 12 is also provided with a second circumferential portion 20. The second circumferential portion 20 is located next to a substance delivery system (dispenser) 18. The substance delivery system 18 shown in FIG. 1 is an ink jet printer 34. The ink jet printer 34 is a device commonly known in the art. A print head 36 is present on the ink jet printer 34 and is located proximate to the second circumferential portion 20 of the transfer roll 12. In certain exemplary embodiments of the present invention, the print head 36 may be heated. The print head 36 may be any type of print head commonly known in the art. For instance, U.S. Pat. Nos. 6,000,787 and 6,084,609 show two typical ink jet print heads that are commonly used in ink jet technology. However, it is to be noted that the ink jet print heads shown in these two references are used for placing ink onto a paper surface and not a substance that modifies the chemical properties of the paper or web as is the case in certain exemplary embodiments in the present disclosure.

The ink jet printer 34 of FIG. 1 is provided with a positive pressure enclosure 28. The function of the positive pressure enclosure 28 is to keep the area surrounding the print head 36 and the ink jet printer 34 clean. The positive pressure enclosure is not limited to a particular size or shape. As stated, an amount of dust or lint may build up on the print head 36 during use. It is important to keep the print head 36 along with the ink jet printer 34 free from dust and lint in order to ensure for a long lasting life of these components and for proper functioning of the offset print apparatus 10. The positive pressure enclosure 28 is provided with an air intake 30 that receives clean air from a blower at a pressurized air source (not shown). This clean air is used in part to prevent the accumulation of dust and lint onto the print head 36 and the ink jet printer 34, and also to help prevent boundary air 40 (shown in a direct print apparatus 50 in FIG. 6) from contacting the print head 36.

Figure 3:
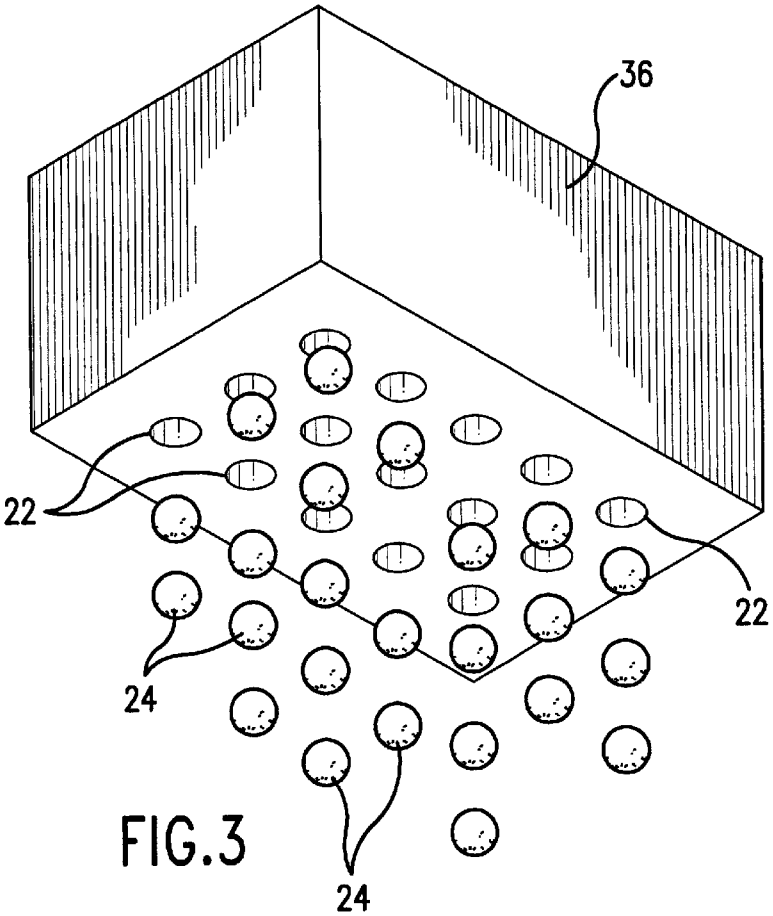
FIG. 3 is a perspective view of a print head in accordance with one exemplary embodiment of the present invention. The print head is shown having a plurality of orifices from which a substance may be dispensed.

The print head 36 may be configured as shown in FIG. 3 in one exemplary embodiment of the present invention. Here, a series of orifices 22 are present on the surface of the print head 36. As used in the art, the orifices 22 are sometimes referred in ink jet technology as being "jets". A substance 24 that effects the functional properties of the web 14 once placed onto the web 14 is dispensed through the orifices 22 of the print head 36. The substance 24 is shown in FIG. 3 as being dispensed through several but not all of the orifices 22, however it is to be understood that in other exemplary embodiments of the present invention the substance 24 may be dispensed through any number or all of the orifices 22. In addition, the substance 24 may be dispensed in unequal amounts through different orifices 22. Any type of configuration of dispensing known in the art is to be covered under the scope of the present invention.

The substance 24 is shown as being in the form of a series of drops. Again, the print head 36 may be modified such that the substance 24 is dispensed in a steady stream or a configuration of drops which takes various shapes. In one exemplary embodiment of the present invention, it may be desired to apply a substance 24 onto the web 14 such that the resulting product has desired hydrophilic properties. The substance 24 may be a material that changes the functional properties of the web 14 or may simply be a material such as ink that marks or writes on the web 14 in other exemplary embodiments. The substance 24 may be a strengthening agent, a softening agent, and/or a debonding agent.

Figure 4:
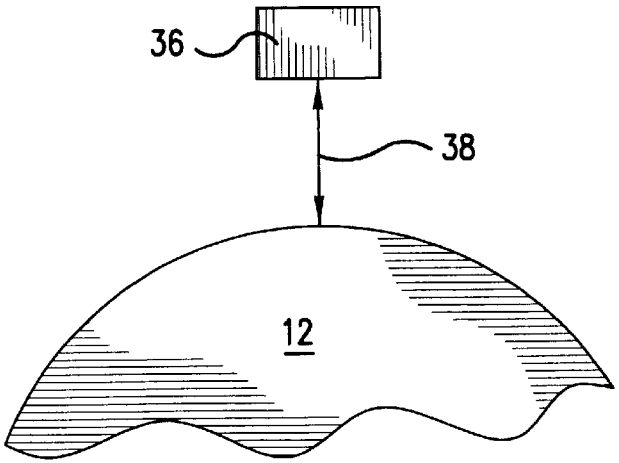
FIG. 4 is a detailed elevational view of a transfer roll and a print head in accordance with one exemplary embodiment of the present invention. The drawing shows the throw distance being the distance between the transfer roll and the print head.

The substance 24 is dispensed in a desired amount from the print head 36. FIG. 4 shows the distance between the print head 36 and the transfer roll 12 as being a throw distance 38. The substance 24 traverses this throw distance 38 either along a substantially straight line or along some other path in order to contact the transfer roll 12 at the second circumferential portion 20 of the transfer roll 12. Referring back to FIG. 1, the transfer roll 12 moves in the direction of arrow B. The substance 24 on the surface of the transfer roll 12 therefore is moved in the direction of arrow B from the second circumferential portion 20 to the first circumferential portion 16 of the transfer roll 12. At this point, the web 14 contacts the first circumferential portion 16 of the transfer roll 12 such that the substance 24 is transferred to the web 14. The substance 24 is then applied to the web 14 so that the functional properties of the web 14 is modified to a desired state. The web 14 is then moved over a downstream directional roll 42 and moved to a subsequent manufacturing stage. A backing roll 15 may be present and form a nip with the transfer roll 12 into which the web 14 is drawn. The backing roll 15 may be either independently driven or driven by the transfer roll 12. The backing roll 15 in some exemplary embodiments aids in the transfer of the substance 24 onto the web 14.

Ink jet printing technology makes use of throw distances 38 that are usually less than fifteen millimeters and commonly are less than five millimeters. In addition, is also very common to have a throw distance 38 that is between about two and three millimeters. As can be expected, with such small throw distances, dust from the web 14 may buildup on the print head 36 very rapidly due to static effects.

Figure 2:
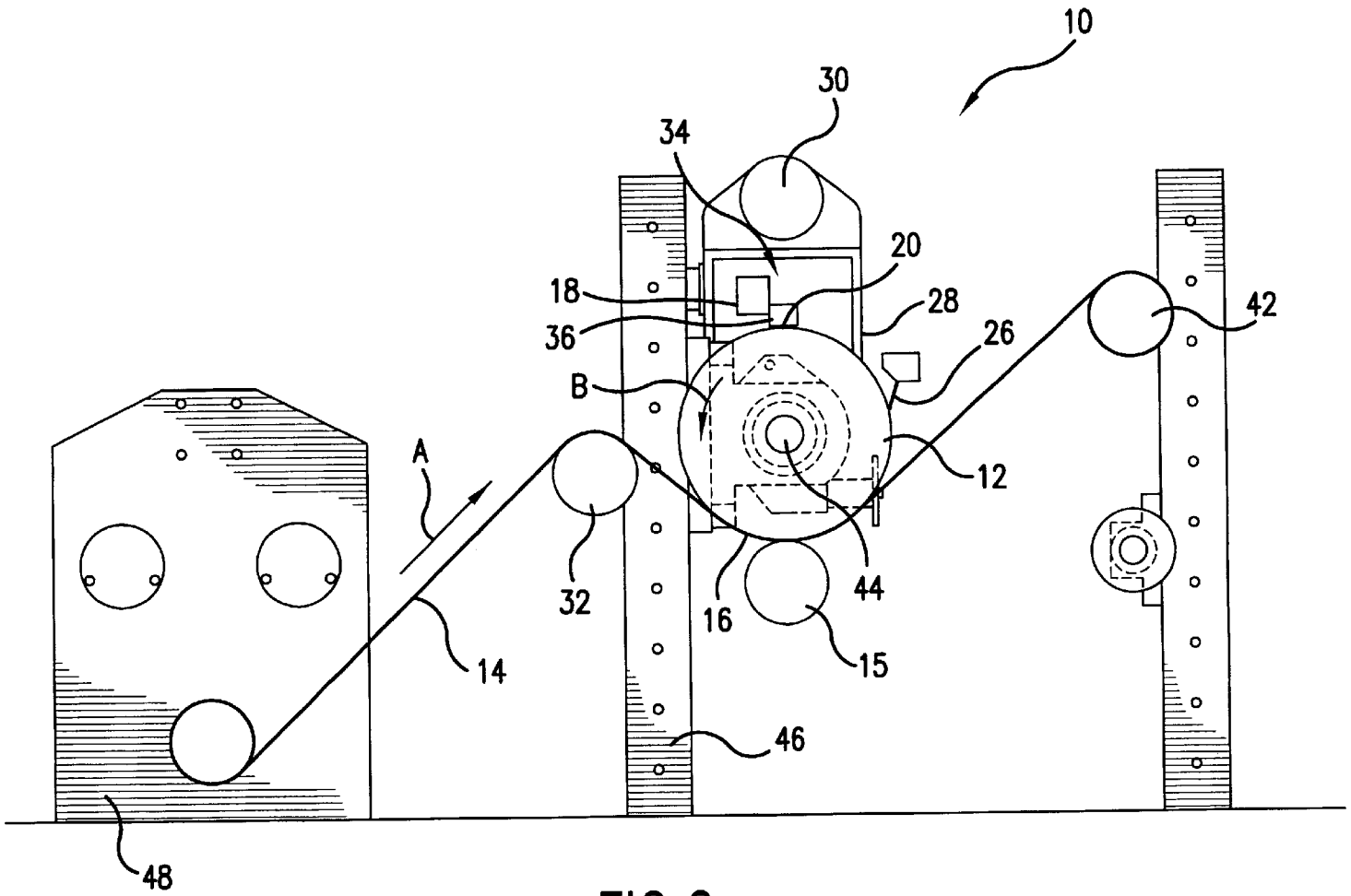
FIG. 2 is an elevational view of an exemplary embodiment of an offset print apparatus in accordance with the present invention. The offset print apparatus has a doctor blade that is present to remove any remaining substance that is on the transfer roll after the substance comes into contact with the moving web.

FIG. 2 shows an alternative exemplary embodiment of an offset print apparatus 10 in accordance with the present invention. Here, the offset print apparatus 10 is substantially similar to the one disclosed in FIG. 1. However, the offset print apparatus 10 shown in FIG. 2 has a doctor blade 26 being present and contacting the transfer roll 12. The purpose of doctor blade 26 is to remove any extra substance 24 that remains on the transfer roll 12 after the substance 24 contacts the web 14. This is done in order to ensure that an even distribution of the substance 24 is attained on the web 14. If the substance 24 were allowed to remain on the transfer roll 12, an uneven distribution would occur once the new amount of substance 24 were applied to the transfer roll 12 and moved into contact with the web 14. In some applications, a doctor blade 26 is not necessary since all of the substance 24 is transferred onto the web 14. In addition, in other applications it may be desirable to have an uneven distribution of the substance 24 onto the web 14 such that the doctor blade 26 is not needed. Further, the substance 24 may change the color of the web 14 or may print a design or writing onto the web 14. Additionally, the substance 24 may be an odor control agent that is used to change the odor of web 14.

Figure 5:
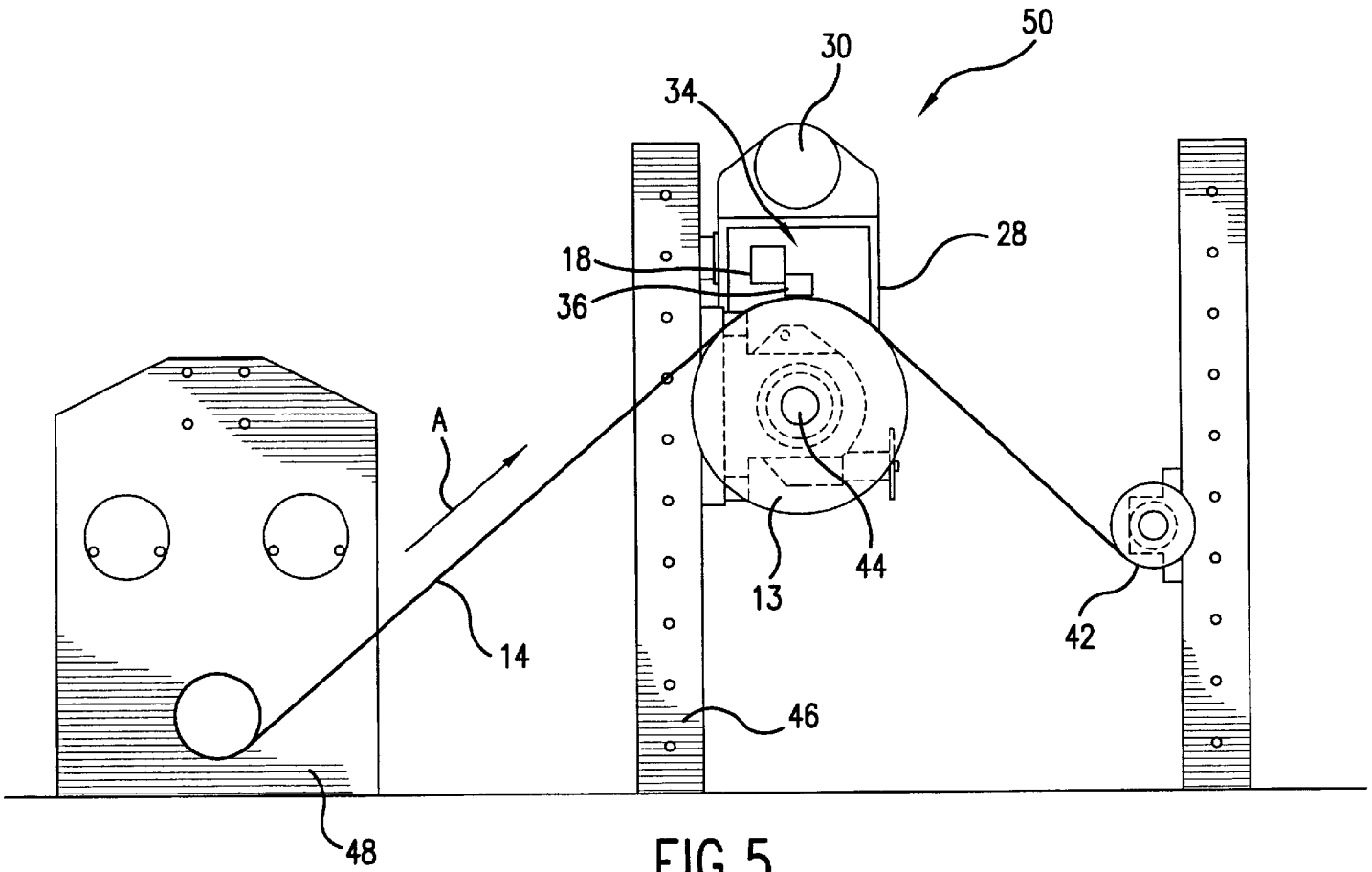
FIG.5 PRIOR ART
FIG. 5 is an elevational view of a direct print apparatus. The direct print apparatus makes use of a print head that prints directly onto the web.

FIG. 5 shows a direct print apparatus 50. The most substantial difference between the direct print apparatus 50 of FIG. 5 and the offset print apparatus 10 of FIG. 1 is that the print head 36 of the direct print apparatus 50 dispenses the substance 24 directly onto the web 14. Although a guide roll 13 is shown in FIG. 5, the ink jet printer 34 and the print head 36 do not dispense the substance 24 directly onto the guide roll 13 to be later transferred to the web 14 as is the case in the offset print apparatus 10 of FIG. 1. The direct print apparatus 50 of FIG. 5 has the moving web 14 being turned around the guide roll 13 . At essentially the same time, substance 24 from the print head 36 is applied to the web 14.

Figure 6:
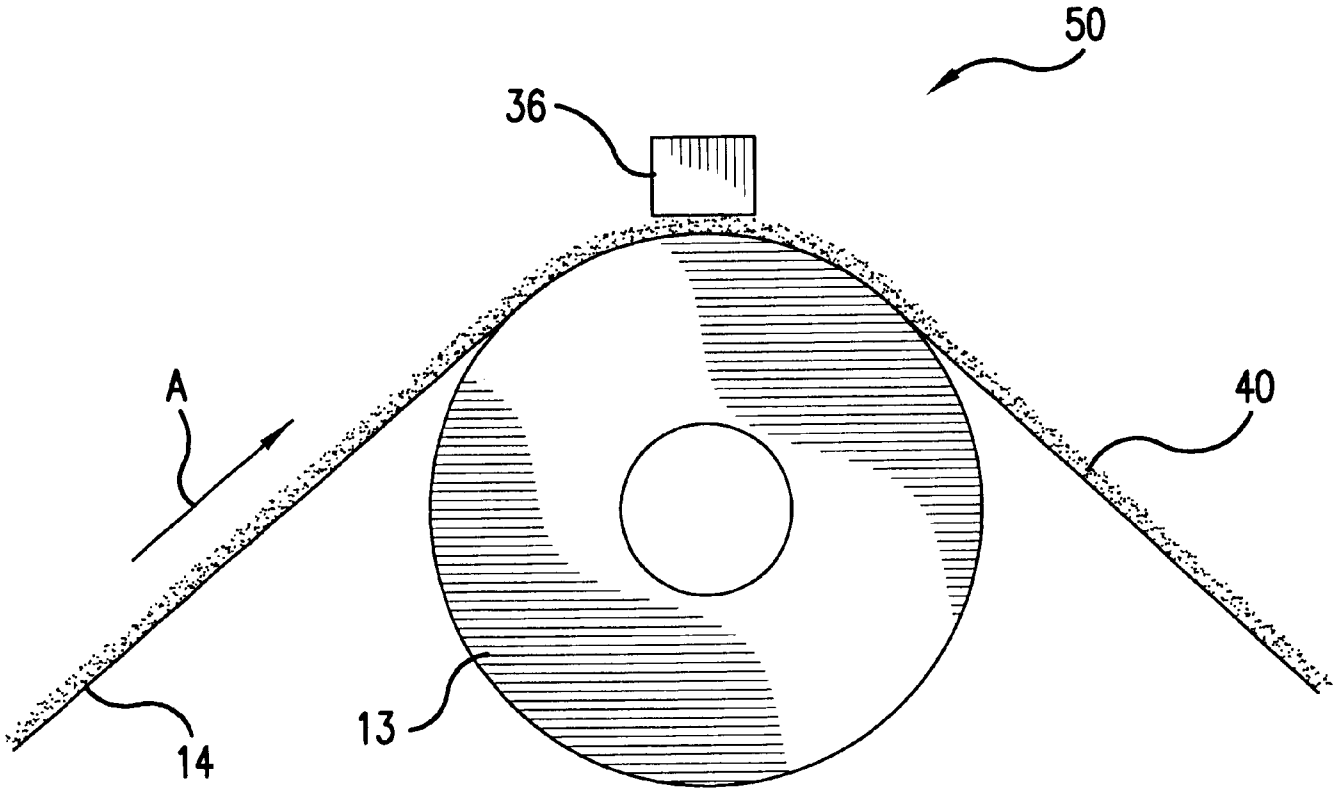
FIG. 6 is a detailed view of the guide roll and the print head of a direct print apparatus. A layer of boundary air is shown being formed above the moving web.

FIG. 6 shows a detailed view of the direct print apparatus 50 of FIG. 5. Here, the web 14 is shown being moved around the guide roll 13 with the print head 36 being proximate to the guide roll 13. The web 14 is made of material that when moved creates a layer of boundary air 40 proximate to the web 14. Typically, the moving web 14 will create a layer of boundary air that is approximately one-half inch to one inch away from the surface of the web 14. The layer of boundary air 40 is laden with dust and other particles that make up the web 14. Additionally, other particles may also be present in the boundary air 40 that are not part of the web 14. The boundary air 40 is a turbulent flow that has a significant amount of dust contained therein. As can be seen in FIG. 6, the print head 36 is located inside of the boundary air 40. The print head 36 therefore acts to disrupt the turbulent airflow of the boundary air 40 and create an even greater agitation of dust and other particles at the print head 36 and the area between the print head 36 and the guide roll 13.

Figure 7:
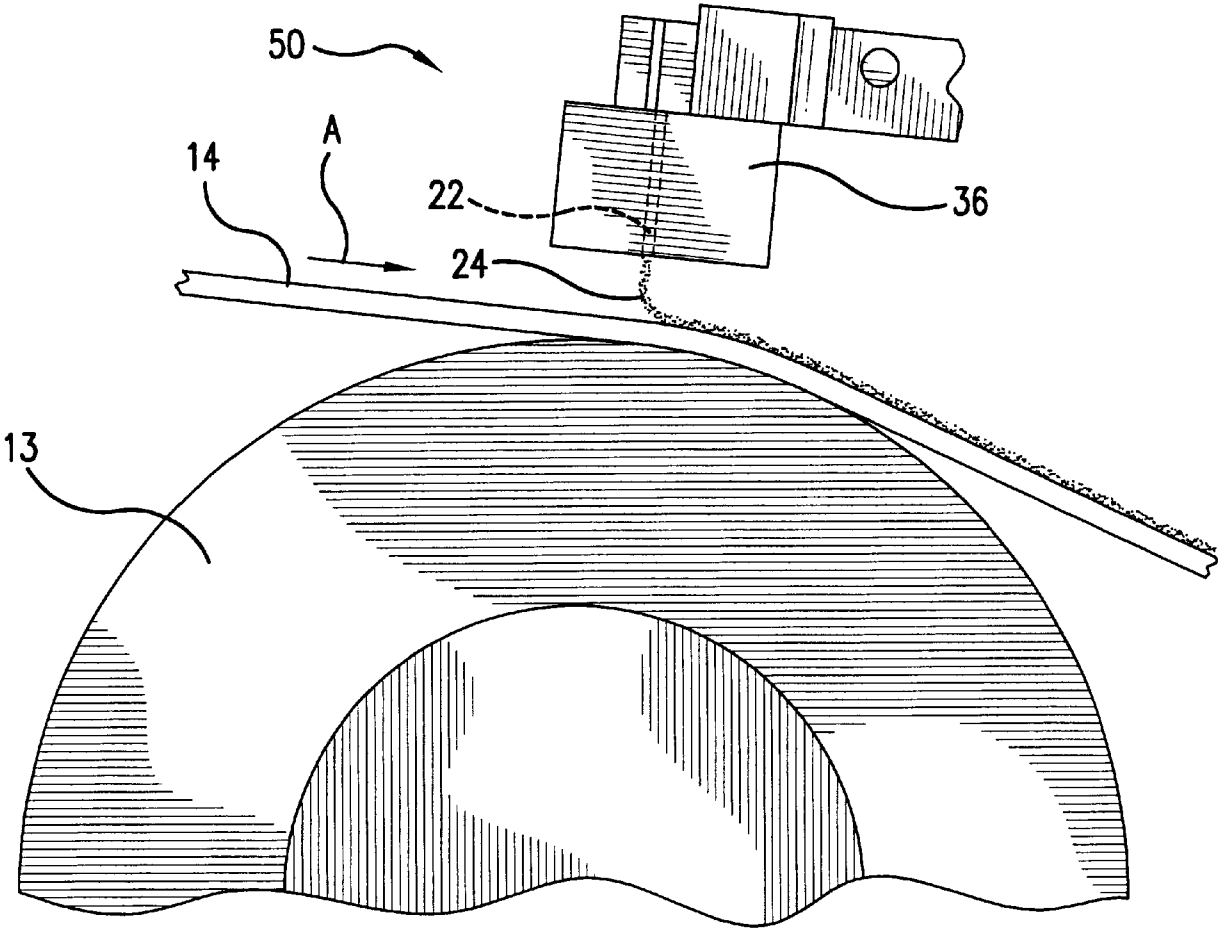
FIG. 7 is a detailed view of a direct print apparatus. The drawing shows the web moving underneath a print head. In this drawing, the moving web has just begun moving and a substance is shown being applied by the print head to the moving web.

FIG. 7 shows the direct print apparatus 50 as the web 14 begins moving from an at rest position. The substance 24 is shown being dispensed from an orifice 22 of the print head 36. The web 14 contacts the guide roll 13 on one end and on the other end is applied with the substance 24 from the print head 36. The web 14 is moving in the direction of arrow A as indicated in FIG. 7. As can be seen, once the web 14 begins moving, immediately afterwards the dispensing of the substance 24 is normal since there is no dust buildup on the print head 36.

Figure 8:
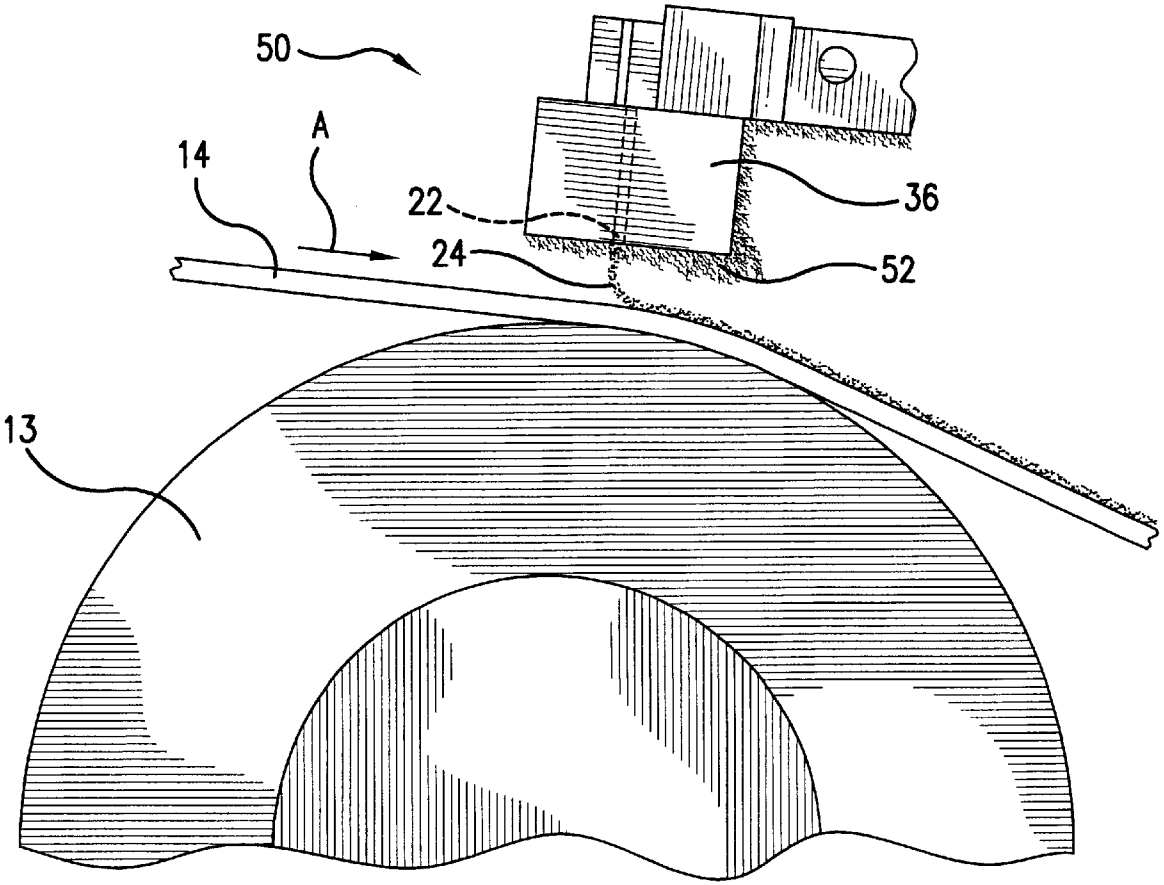
FIG. 8 shows a detailed view of the direct printing apparatus shown in FIG. 7. Here, the drawing shows the print head shortly after the print head shown in FIG. 7. An amount of dust has accumulated on the print head.

FIG. 8 shows the direct print apparatus 50 of FIG. 7 after some period of time has elapsed between the starting of the web 14 shown in FIG. 7. Here, an amount of dust 52 has accumulated on the print head 36. This dust 52 is also present within the orifice 22 from which the substance 24 is dispensed. The dust 52 interferes with the dispensing of the substance 24 such that the substance 24 is not evenly dispensed on the web 14. An uneven distribution of the substance 24 on the web 14 is undesirable in some applications because the resulting product will have inconsistent properties throughout.

Again, the accumulation of dust 52 onto the print head 36 is undesirable in that it impedes the proper functioning of the dispensing of the substance 24 from the print head 36. In some cases, the dust 52 may completely clog or jam the orifices 22, shown in FIG. 3, and prevent any of the substance 24 from being dispensed. In other instances, the dust 52 may impede the flow of the substance 24 such that satellite drops of the substance 24 are formed. These satellite drops are smaller drops which have been removed from the main drop of the substance 24. Also, these satellite drops may be so small and have a smaller weight such that they are swept away by the fast moving boundary air 40. Such a result is undesirable in that the satellite drops will be blown to an unknown location either on the web 14 or off of the web 14. In such circumstances, the application of the substance 24 onto the web 14 cannot be controlled or predicted with any regularity.

In the offset print apparatus 10 of FIG. 1, the print head 36 does not have dust or lint accumulation as does the direct print apparatus 50 because the air between the print head 36 and the transfer roll 12 in the area of the second circumferential portion 20 of the transfer roll 12 is not laden with dust. As can be seen in FIG. 1, the web 14 moves some distance away from the print head 36 and the offset print apparatus 10. A boundary air 40 (shown in FIG. 6) will be present next to the web 14 in the offset print apparatus 10, however the boundary air 40 does not come into close proximity with the print head 36. Dust or other particles from the boundary air 40 may be transferred upwards due to the rotating motion of the transfer roll 12, however, this type of dust transfer from the web 14 to the print head 36 is minimal as compared to that displayed in the direct print apparatus 50. By use of an offset print apparatus 10, the boundary air 40 that contains lint and dust 52 will be prevented from contacting the surface of the transfer roll 12 proximate to the print head 36. The print head 36 may then be positioned next to the transfer roll 12 such that a small throw distance 38 is present. By making use of a small throw distance 38, the concerns with the boundary air 40 issues are minimized and/or eliminated. In addition, the doctor blade 26 as shown in FIG. 2 may also be used to prevent dust from being transferred from the web 14 to the print head 36. As stated, the doctor blade 26 may also be provided for the function of removing any excess substance 24 from the transfer roll 12.

The offset print apparatus 10 may therefore have a print head 36 that is located very close to the transfer roll 12. Having such a short throw distance 38 provides for a better resolution of the substance 24 dispensed onto the transfer roll 12. Less overlapping will therefore occur with the offset print apparatus 10. In addition, the speed of the web 14 and the transfer process of the substance 24 onto the web 14 can be maximized. The web 14 may be run at a speed of between about 500 and 8,000 feet per minute with the use of an offset print apparatus 10 even if a significant boundary air 40 with dust 52 is present. However, the present invention is not limited to a particular speed of the web 14. For instance, in other exemplary embodiments the speed of the web 14 may be less than 500 feet per minute and/or greater than 8,000 feet per minute.

The present invention also encompasses an exemplary embodiment of an offset print apparatus 10 in which the substance 24 used is a wax chemistry. In such an instance, the print head 36 is typically heated such that the wax chemistry substance 24 does not solidify on the transfer roll 12. A heated transfer roll 12 is incorporated in order to prevent the solidification of the wax chemistry substance 24. Alternatively, a heated transfer roll 12 may be used when the substance 24 is a viscous liquid in order to keep the viscosity low enough for an optimal transfer to the web 14. A heated transfer roll 12 is also advantageous in helping to reduce cooling problems that are associated with printing at high speeds. When the transfer roll 12 revolves at a high rate, air will be blown across the print head 36 such that the print head 36 is cooled which could cause the evaporation of, or an increase in, the evaporation rate of the substance 24 located in the print head 36 or could make the substance 24 inside of the print head 36 more viscous. Additionally, the surface of the transfer roll 12 can become cooled due to a faster movement of air around the transfer roll 12. In all of such instances, a heated transfer roll 12 can help to reduce the cooling effect of the rotating transfer roll 12 and increase the efficiency of the transfer between the substance 24 and the web 14 and maintain consistent properties of the substance 24.

Figure 9:
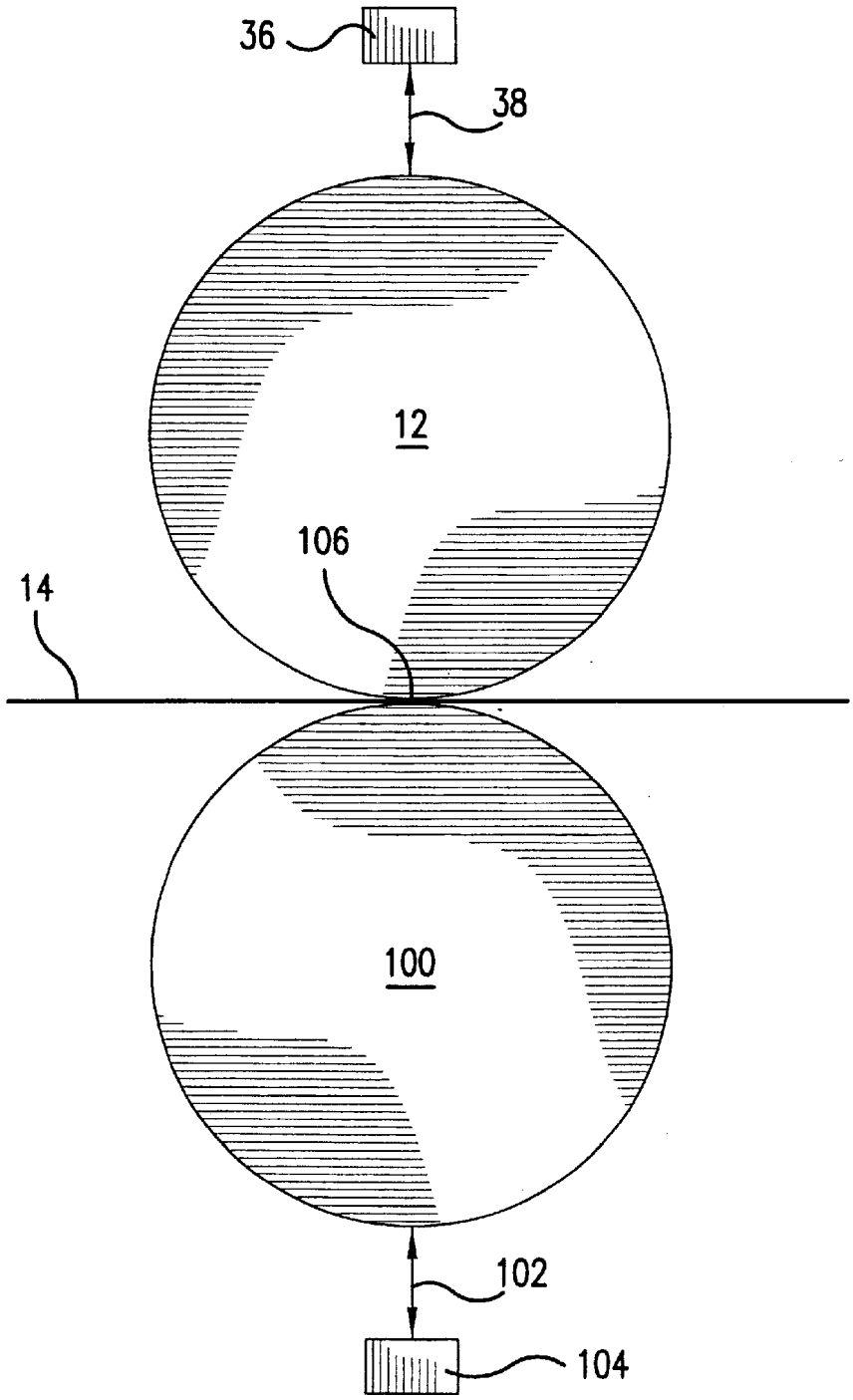
FIG. 9 is an elevation view of an exemplary embodiment of an offset print apparatus in accordance with the present invention. Two transfer rolls and print heads are present in order to apply a substance to both sides of a web.

FIG. 9 shows another exemplary embodiment of the present invention. Here, a second transfer roll 160 is positioned proximate to the transfer roll 12 in order to form a nip 106 into which the web 14 may be drawn. A second dispenser 104 (shown as a print head) is present and located a second throw distance 102 from the second transfer roll 100. The second throw distance 102 may or may not be the same distance as the throw distance 38. Additionally, the second transfer roll 100 may or may not be of the same size, or have the same surface configuration as the transfer roll 12. The second print head 104 may apply the substance 24 onto the second transfer roll 100 along the same lines as discussed above in regards to the transfer roll 12 and the print head 36.

The second transfer roll 100 may be rotated in a direction opposite to the transfer roll 12, causing the substance 24 to be applied to the web 14 at a location at or proximate to the nip 106. The application of the substance 24 by the second transfer roll 100 is on an opposite side of the web 14 than that applied by the transfer roll 12. As such, the arrangement in FIG. 9 allows for application of the substance 12 on both sides of the web 14. Such an application may provide for desired changes in the functional properties of the web 14. In other exemplary embodiments, the direct print apparatus 50 may be used along with the offset print apparatus 10 to obtain a desired application. The substance 24 applied onto either side of the web 14 may or may not be the same substance 24 and may or may not be applied in the same amount. As used in the claims, the word "substance" may be the same or different substance 24 when applied on either side of the web 14.

In one exemplary embodiment of the present invention, the substance 24 is a lotion. The lotion can be water-based or oil-based. Suitable water based compositions include, but are not limited to, emulsions and water-dispersible compositions which can contain, for example, debonders (cationic, anionic or nonionic surfactants), or polyhdroxy compounds such as glycerin or propylene glycol. The web 14 could be treated with a bi-component system comprising a debonder and a polyhydroxy compound. Both components can be added separately or mixed together prior to being applied to the web 14.

Oil-based compositions can include combinations of oil and wax. In particular embodiments, the products into which the web 14 is formed are made by applying, on the surface(s) of the web 14, large numbers of individual deposits of a melted moisturizing/protective additive composition comprising a wax and an oil, and thereafter resolidifying the composition to form a distribution, of solid deposits on the surface(s) of the web 14. Because the composition is a solid or a semi-solid at room temperature and rapidly solidifies after deposition, it has less tendency to penetrate and migrate into the sheet. Compared to products treated with liquid formulations, this leaves a greater percentage of the lotion on the surface of the web 14 where it can contact and/or transfer to the user's skin to provide a benefit. Thus, a lower add-on amount can be used to deliver the same benefit at lower cost because of the efficient placement of the composition substantially at the surface of the product.

The lotion may comprise solidified deposits of a composition comprising from about 30 to about 90 weight percent oil, and from about 10 to about 40 weight percent wax, preferably also containing from about 5 to about 40 weight percent fatty alcohol. The composition can have a melting point of from about 30° C. to about 70° C. For purposes herein, "melting point" is the temperature at which the majority of the melting occurs, it being recognized that melting actually occurs over a range of temperatures.

The amount of oil in the composition can be from about 30 to about 90 weight percent. Suitable oils include, but are not limited to, the following classes of oils: petroleum or mineral oils, such as mineral oil and petrolatum; animal oils, such as mink oil and lanolin oil; plant oils, such as aloe extract, sunflower oil and avocado oil; and silicone oils, silicone fluids, or silicone emulsions. For example, dimethicone and alkyl methyl silicones could be used.

The amount of wax in the composition can be from about 10 to about 60 weight percent. Suitable waxes include, but are not limited to the following classes: natural waxes, such as beeswax and carnauba wax; petroleum waxes, such as paraffin and ceresine wax; silicone waxes, such as alkyl methyl siloxanes; or synthetic waxes, such as synthetic beeswax and synthetic sperm wax.

The amount of fatty alcohol in the composition, if present, can be from about 5 to about 40 weight percent. Suitable fatty alcohols include alcohols having a carbon chain length of $C^{14}$–$C^{30}$, including acetyl alcohol, stearyl alcohol, behenyl alcohol, and dodecyl alcohol.

It should be understood that the web 14 may be any type of web known in the art, and the present invention encompasses all such types of webs. For instance, the web 14 may be a woven web in one exemplary embodiment of the present invention, and may be a non-woven web in another exemplary embodiment.

It should be understood that the present invention includes other various modifications that can be made to embodiments of the offset print apparatus 10 as described herein as come within the scope of the appended claims and their equivalents.

What is claimed is:

1. An offset print apparatus for applying a substance to a moving web, comprising:

a transfer roll capable of being rotated;

a moving web in contact with a first circumferential portion of said transfer roll, said moving web moving over or under said transfer roll and staying in contact with said first circumferential portion of said transfer roll while moving over or under said transfer roll;

a dispenser located proximate to a second circumferential portion of said transfer roll, said dispenser having at least one orifice;

a substance being dispensed from said dispenser through said at least one orifice and onto said transfer roll without having said dispenser contact said transfer roll, said transfer roll rotating said substance into engagement with said moving web such that at least a portion of said substance is applied to said moving web; and a positive pressure enclosure in fluid communication with said dispenser such that said positive pressure enclosure communicates clean air to said dispenser in order to aid in preventing build-up of dust on said dispenser.

2. The offset print apparatus of claim 1, wherein said substance is applied to effect the functional properties of said web.

3. The offset print apparatus of claim 1, wherein said substance is selected from the group consisting of strength agents, softening agents, and debonding agents.

4. The offset print apparatus of claim 1, wherein said transfer roll is a vacuum roll.

5. The offset print apparatus of claim 1, wherein:

said substance is a room temperature solid or semi-solid; and said transfer roll is heated.

6. The offset print apparatus of claim 1, wherein said transfer roll is a heated transfer roll.

7. The offset print apparatus of claim 1, wherein said dispenser is an ink jet printing apparatus.

8. The offset print apparatus of claim 1, further comprising a doctor blade located proximate to said transfer roll, said doctor blade removing any of said substance remaining on said transfer roll after engagement of said substance with said moving web such that said doctor blade is capable of removing excess substance.

9. The offset print apparatus of claim 1, wherein said moving web is moving at a speed of between about 500 feet per minute and about 3,000 feet per minute.

10. An offset print apparatus for applying a substance to a moving web, comprising:

a transfer roll capable of being rotated;

a moving web in contact with a first circumferential portion of said transfer roll, said moving web moving over or under said transfer roll and staving in contact with said first circumferential portion of said transfer roll while moving over or under said transfer roll;

a dispenser located proximate to a second circumferential portion of said transfer roll, said dispenser having at least one orifice;

a substance being dispensed from said dispenser through said at least one orifice and onto said transfer roll without having said dispenser contact said transfer roll, said transfer roll rotating said substance into engagement with said moving web such that at least a portion of said substance is applied to said moving web; and wherein said moving web is moving at a speed of between about 3,000 feet per minute and about 5,000 feet per minute.

11. An offset print apparatus for applying a substance to a moving web, comprising:

a transfer roll capable of being rotated;

a moving web in contact with a first circumferential portion of said transfer roll, said moving web moving over or under said transfer roll and staving in contact with said first circumferential portion of said transfer roll while moving over or under said transfer roll;

a dispenser located proximate to a second circumferential portion of said transfer roll, said dispenser having at least one orifice;

a substance being dispensed from said dispenser through said at least one orifice and onto said transfer roll without having said dispenser contact said transfer roll, said transfer roll rotating said substance into engagement with said moving web such that at least a portion of said substance is applied to said moving web; and wherein said moving web is moving at a speed of between about 5,000 feet per minute and about 8,000 feet per minute.

12. The offset print apparatus of claim 10, wherein said moving web is a tissue web.

13. The offset print apparatus of claim 1, further comprising a backing roll engaging said moving web and forming a nip with said transfer roll.

14. An offset print apparatus for applying a substance to a moving web, comprising:

a transfer roll capable of being rotated;

a moving web in contact with a first circumferential portion of said transfer roll, said moving web moving over or under said transfer roll and staying in contact with said first circumferential portion of said transfer roll while moving over or under said transfer roll;

a dispenser located proximate to a second circumferential portion of said transfer roll, said dispenser having at least one orifice;

a substance being dispensed from said dispenser through said at least one orifice and onto said transfer roll without having said dispenser contact said transfer roll, said transfer roll rotating said substance into engagement with said moving web such that at least a portion of said substance is applied to said moving web; and an upstream directional roll located upstream of said transfer roll.

15. The offset print apparatus of claim 1, further comprising:

a second transfer roll located on an opposite side of said moving web than said transfer roll, said moving web in contact with a first circumferential portion of said second transfer roll, said moving web moving over or under said second transfer roll and staying in contact with said first circumferential portion of said second transfer roll while moving over or under said second transfer roll;

a second dispenser located proximate to a second circumferential portion of said second transfer roll, said second dispenser having at least one orifice; and said substance being dispensed from said second dispenser through said at least one orifice and onto said second transfer roll without having said second dispenser contact said second transfer roll, said second transfer roll rotating said substance into engagement with said moving web such that at least a portion of said substance is applied to said moving web on an opposite side of said moving web than that applied by said transfer roll.

16. The offset print apparatus of claim 15, wherein said transfer roll and said second transfer roll form a nip into which said moving web is drawn.

17. The offset print apparatus of claim 1, wherein the distance between an exit of said at least one said orifice and said second circumferential portion of said transfer roll is less than about twenty millimeters.

18. The offset print apparatus of claim 1, wherein said substance is applied to both sides of said web.

19. The offset print apparatus of claim 1, wherein said substance changes the color of said web.

20. The offset print apparatus of claim 1, wherein said substance causes a design to be printed onto said web.

21. The offset print apparatus of claim 1, wherein said substance comprises an odor control agent.

22. The offset print apparatus of claim 1, wherein said substance comprises at least in part water.

23. An offset print apparatus for applying a substance to a web, comprising:

a transfer roll capable of being rotated;

an ink jet printer having a print head located proximate to said transfer roll, said print head having a plurality of orifices from which the substance is dispensed onto said transfer roll, the throw distance between the surface of said print head and said transfer roll;

a web contacting said transfer roll such that the substance dispersed onto said transfer roll is transferred to said web through contact of said transfer roll and said web, said web having an amount of boundary air formed proximate to said web when said web is moving, wherein said print head of said ink jet printer is not in contact with boundary air; and wherein said web is being moved at speeds between 1000 feet per minute and less than 3,000 fee per minute.

24. The offset print apparatus of claim 23, wherein said throw distance is between about two and about twenty millimeters.

25. An offset print apparatus for applying a substance to a web, comprising:

a transfer roll capable of being rotated;

an ink jet printer having a print head located proximate to said transfer roll, said print head having a plurality of orifices from which the substance is dispensed onto said transfer roll, the throw distance between the surface of said print head and said transfer roll;

a web contacting said transfer roll such that the substance dispersed onto said transfer roll is transferred to said web through contact of said transfer roll and said web, said web having an amount of boundary air formed proximate to said web when said web is moving, wherein said print head of said ink jet printer is not in contact with boundary air;

wherein said throw distance is between about two and about twenty millimeters; and wherein said web is being moved at speeds of between about 5,000 feet per minute and about 8,000 feet per minute.

26. An offset print apparatus for applying a substance to a web, comprising:

a transfer roll capable of being rotated;

an ink jet printer having a print head located proximate to said transfer roll, said print head having a plurality of orifices from which the substance is dispensed onto said transfer roll, the throw distance between the surface of said print head and said transfer roll;

a web contacting said transfer roll such that the substance dispersed onto said transfer roll is transferred to said web through contact of said transfer roll and said web, said web having an amount of boundary air formed proximate to said web when said web is moving, wherein said print head of said ink jet printer is not in contact with boundary air;

wherein said throw distance is between about two and about twenty millimeters; and wherein said web is being moved at speeds of between about 3,000 feet per minute and about 5,000 feet per minute.

27. The offset print apparatus of claim 23, wherein said print head of said ink jet printer is heated.

28. The offset print apparatus of claim 23, wherein said transfer roll is a heated transfer roll.

29. The offset print apparatus of claim 23, wherein said transfer roll is a vacuum roll.

30. The offset print apparatus of claim 23, further comprising:

a second transfer roll capable of being rotated;

a second ink jet printer having a second print head located proximate to said second transfer roll, said second print head having a plurality of orifices from which the substance is dispensed onto said second transfer roll, the distance between the surface of said second print head and said second transfer roll being defined as a throw distance;

said web contacting said second transfer roll such that the substance dispensed onto said second transfer roll is transferred to said web through contact of said second transfer roll and said web on an opposite side of said web than the substance applied by said transfer roll; and wherein said second print head is not in contact with boundary air.

31. The offset print apparatus of claim 23, further comprising a doctor blade located proximate to said transfer roll, said doctor blade capable of removing any of the substance remaining on said transfer roll after engagement of the substance with said web.

32. The offset print apparatus of claim 23, further comprising a positive pressure enclosure located over said ink jet printer.

33. An offset print apparatus for applying a substance to a web, comprising:

a transfer roll capable of being rotated;

an ink jet printer having a print head located proximate to said transfer roll, said print head having a plurality of orifices from which the substance is dispensed onto said transfer roll, the throw distance between the surface of said print head and said transfer roll;

a web contacting said transfer roll such that the substance dispersed onto said transfer roll is transferred to said web through contact of said transfer roll and said web, said web having an amount of boundary air formed proximate to said web when said web is moving, wherein said print head of said ink jet printer is not in contact with boundary air;

a downstream directional roll located downstream of said transfer roll; and an upstream directional roll located upstream of said transfer roll.

34. The offset print apparatus of claim 23, wherein said throw distance is between about one millimeter and about twenty millimeters.

35. An offset print apparatus for applying a substance to a moving web, comprising:

a rotating transfer roll;

a moving web in contact with a first circumferential portion of said transfer roll, said moving web moving over or under said transfer roll and staying in contact with said first circumferential portion of said transfer roll while moving over or under said transfer roll;

an ink jet printer having a print head located proximate to a second circumferential portion of said transfer roll, said print head having a plurality of orifices from which a substance is dispensed onto said second circumferential portion of said transfer roll, the throw distance between said print head and said second circumferential portion is less than about twenty millimeters in length; and a substance being dispensed from said print head and onto said second circumferential portion of said transfer roll, rotation of said transfer roll moving said substance into contact with said moving web and transferring said substance onto said moving web; wherein movement of said web creates an amount of dust laden boundary air proximate to said moving web, said print head being spaced away from and not in contact with the boundary air formed by said moving web; and a positive pressure enclosure in fluid communication with said ink jet printer such that said positive pressure enclosure communicates clean air to said print head in order to aid in preventing build-up of dust on said print head.

* * * * *

UNITED STATES PATENT AND TRADEMARK OFFICE

CERTIFICATE OF CORRECTION

PATENT NO. : 6,698,877 B2
DATED : March 2, 2004
INVENTOR(S) : John J. Urlab et al.

It is certified that error appears in the above-identified patent and that said Letters Patent is hereby corrected as shown below:

Column 10,
Lines 28 and 48, “staving” should read -- staying --.

Signed and Sealed this

Twenty-first Day of September, 2004

JON W. DUDAS
*Director of the United States Patent and Trademark Office*